United States Patent [19]

Housman

[11] 4,076,129

[45] Feb. 28, 1978

[54] FRICTION MECHANISM FOR DRAFT GEAR

[75] Inventor: Richard J. Housman, Dolton, Ill.

[73] Assignee: Westinghouse Air Brake Company, Wilmerding, Pa.

[21] Appl. No.: 725,513

[22] Filed: Sep. 22, 1976

[51] Int. Cl.[2] ..... B61G 9/10

[52] U.S. Cl. ..... 213/33; 213/32 R

[58] Field of Search ..... 213/22, 23, 24, 31, 213/32 R, 33, 34

[56] References Cited

U.S. PATENT DOCUMENTS

| | | | |
|---|---|---|---|
| 1,914,051 | 6/1933 | Sproul | 213/33 |
| 1,930,701 | 10/1933 | Tucker | 213/33 |
| 2,916,163 | 12/1959 | Campbell | 213/32 R X |

*Primary Examiner*—Barry L. Kelmachter
*Attorney, Agent, or Firm*—McWilliams & Mann

[57] ABSTRACT

A friction cushioning mechanism for draft gear of the combination type including a housing defining an inner or rear chamber in which is mounted a cushioning mechanism that may selectively be of the hydraulic or steel or rubber spring types, and an outer or front chamber in which is mounted a friction mechanism of the type disclosed in U.S. Pat. No. 2,916,163, in which the side edge lugs of the friction mechanism inner fixed friction plates, that key such plates to the housing against movement longitudinally of the housing, are specially formed to resist tendencies of such fixed plates to rock outwardly of the housing under laterally acting force concentrations applied to same during the early part of the draft gear closure stroke, and to avoid deformation of the housing ribs they engage that would introduce looseness in the fit of the friction mechanism parts and consequent reduction in useful life of the gear.

4 Claims, 6 Drawing Figures

FIG. 4
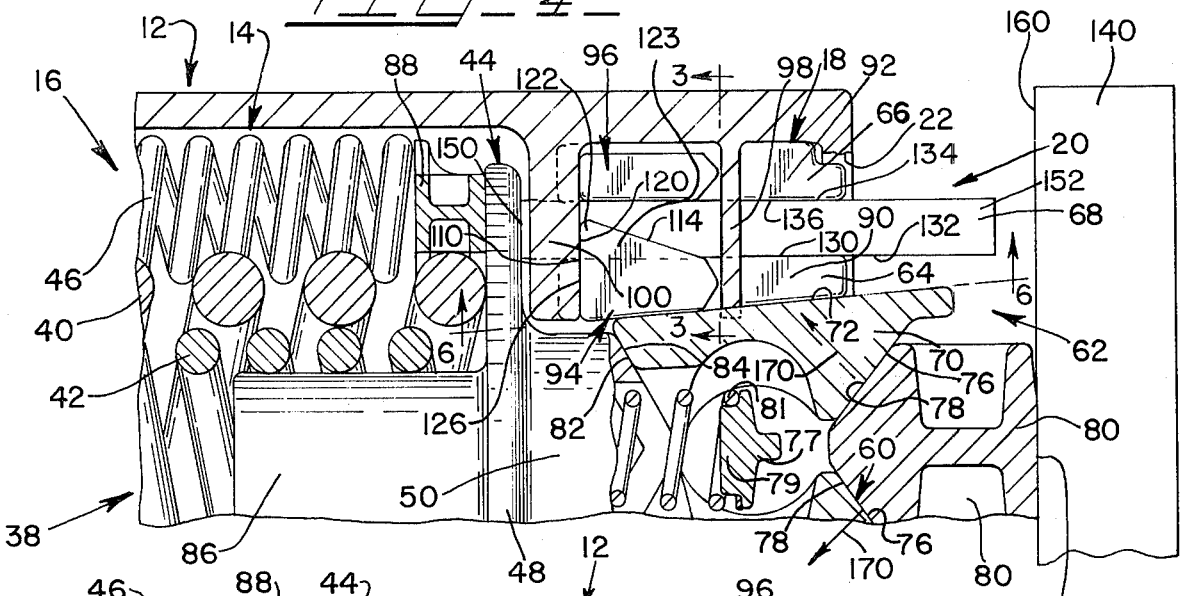
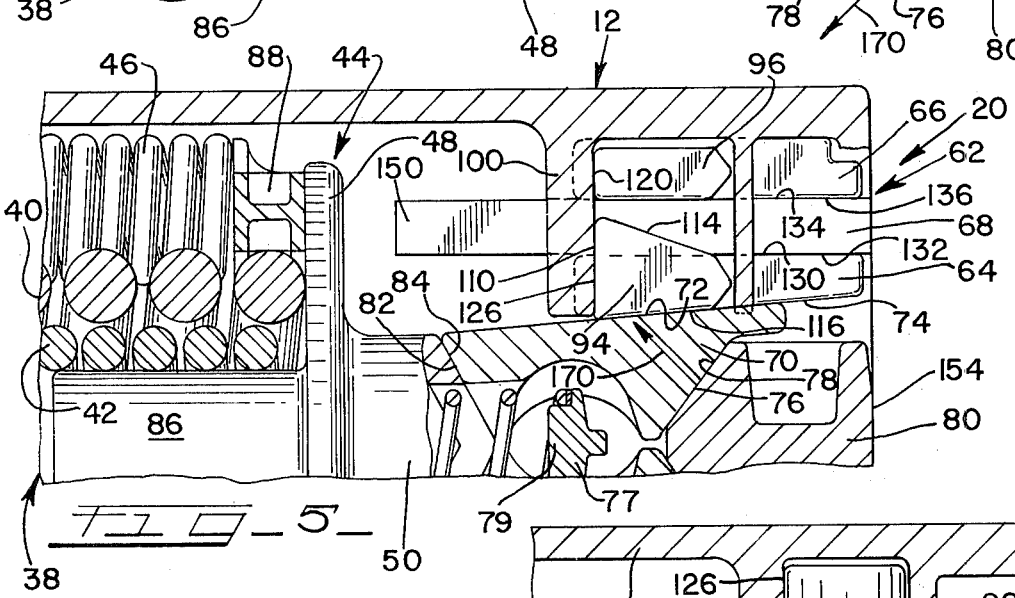
FIG. 5
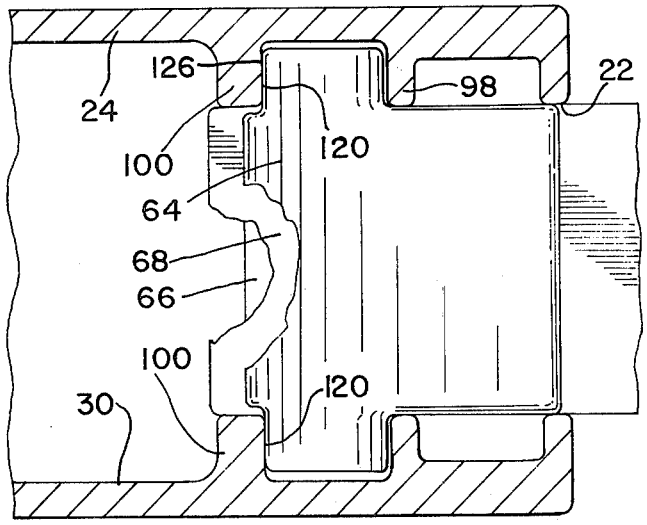
FIG. 6

FRICTION MECHANISM FOR DRAFT GEAR

This invention relates to draft gear for railroad cars, and more particularly to railroad car draft gear of the type disclosed in U.S. Pat. Nos. 2,916,163, 3,150,782, and 3,178,036 (the disclosures of which are hereby incorporated herein by this reference).

Draft gear of this type comprise a housing defining an inner or rear chamber at the closed rear wall of the housing in which is mounted a cushioning mechanism of one of the types shown in said patents, and an outer or front chamber which is open at the front of the housing, in which a friction mechanism is mounted, with the two mechanisms acting on either side of and against an intermediate front follower or spring seat. The friction mechanism includes a pair of oppositely acting wedge shoes having outwardly facing wedge surfaces each acting laterally outwardly of the housing, under the action of a thrust wedge engaged by the follower block that forms the front follower of the gear assembly. The respective wedge shoes have their wedge surfaces bearing on an inner fixed frictional plate that in turn bears against a movable plate that is acted on by the gear front follower at its outer end and acts on the intermediate follower at its inner end under the thrust action provided by the gear front follower. The sidewise thrust acting on each movable plate is transmitted to an outer fixed friction plate that is keyed to the housing at eigher side of the friction mechanism.

As illustrated by the above identifed patents, the cushioning mechanism of the inner chamber may be of the coil spring, hydraulic, or rubber spring types or combinations of same.

A critical factor in the useful life of this type of gear is the wear occasioned on the friction mechanism and housing parts associated with same, as this will affect the amount the friction wedge projects beyond the movable plates for engagement with the gear front follower. As the friction mechanism parts wear, the friction shoes shift laterally outwardly of the housing to the point where, in the neutral or riding position of the gear, the outer ends of the movable plates will be flush with the outer end of the friction wedge so that the front follower will be in engagement with both the movable plates and the friction wedge in the riding or neutral position of the gear.

At this stage the life expectancy of the gear is considered expended to the point that shopping of the car will be required to repair and replace the gear parts as may be necessary by the condition of wear involved. This is due to the fact that when a locomotive is to put a train of railroad cars into motion, it is necessary that there be enough "play" in the connected train of cars so that the individual cars may be started in sequence starting from the front end of the train. In connection with gear of the type indicated, this "play" in the connection of individual cars is provided by the preliminary movement of the gear thrust wedge, and under the action of the front follower, prior to engagement of the front follower with the movable plates, as part of the closure stroke of the gear. When this preliminary gear closure motion of the gear is unavailable due to the wear of the friction mechanism parts indicated, to the extent that the gear front follower engages both the thrust wedge and the movable plates in the neutral position of the gear, the essential car starting "give", in the connection of the individual car in the train of cars, is lacking and thereby greatly impedes the starting up of the full train into motion, resulting in undesirable wear on both the track and the locomotive driving wheels.

Furthermore, in draft gear of the type indicated, when, during the gear closure stroke, the front follower engages the gear movable plates 68, the wedge shoes 70 are relieved of thrust loading against the intermediate follower. This leaves them in a loosened condition that can result in their getting out of alignment. This problem is aggravated by wear that is occasioned where the inner ends of the fixed inner plates abut the housing ribs that are provided for that purpose. The housing ribs in question can become significantly indented under the thrust actions involved, with any indentation at all introducing undesirable additional play into the movement of the friction mechanism movable plates that under the forces involved tends to urge the movable plates outwardly toward the front follower as the gear returns to neutral position after having an impact applied thereto, thus, further reducing the necessary aforementioned preliminary closure movement of the gear as well as reducing the gear life expectancy correspondingly.

Furthermore, during the preliminary part of the gear closure stroke, the forces acting on the wedge shoes are initially concentrated on their outer ends, which applies laterally directed thrusts on the inner fixed friction plates, tending to rock them outward and rearwardly of the gear housing, against the movable plate they each cooperate with, and subject the movable plates to excessive wear. Since as much as 80 percent of the impacts the gear will be subjected to will be those occasioned by low speed impacts (such as those experienced by train action, wherein the principal loading of the inner fixed friction plates will be located to induce such rotation tendencies), this represents a problem of considerable critical importance.

A principal object of the present invention is to provide a draft gear arrangement of the type indicated in which the friction mechanism is especially arranged to adequately resist excess wear under low speed impact conditions that represent the bulk of the impacts to be handled by the gear during its useful life, while at the same time providing for adequate handling of the occasional higher speed impacts while resisting introduction into the friction mechanism parts of undesirable looseness that will shorten the useful life of the gear.

Another principal object of the invention is to arrange the inner fixed friction plates of the friction mechanism for bracing against rotational tendencies by utilizing the lugs that brace the fixed plates against movement inwardly of the gear on closure travel of the gear.

Other objects of the invention are to provide a draft gear arrangement of the type indicated that is economical of manufacture, convenient to install, and long lived in use.

In accordance with the invention, the inner fixed friction plates of the gear friction mechanism have integral lugs formed on their side edges of special configuration to fit between, at either side edge of the respective fixed plates, spaced pairs of housing ribs that are normal to the respective friction plates. The lugs in question define thrust resisting abutments of extended length and area that project laterally outwardly of the housing, across the space between the respective fixed inner plates and the outer friction plates adjacent same, but short of engagement with the fixed outer friction plates to the extent that no contact will be made with such outer fixed plates by the lugs in question during normal use of the gear, to avoid reducing the frictional action on the movable plates.

The lugs are given a generally triangular thrust resisting configuration whereby the lugs not only resist rocking tendencies, but also provide for direct transmittal of high impact forces transmitted to the fixed plates, through same to the housing ribs in question, while at the same time reducing pressure loadings on the housing rib thrust resisting surfaces such that indentation of same will be avoided.

Other objects, uses, and advantages will be obvious or become apparent from a consideration of the following detailed description and the application drawings in which like parts are indicated by like reference numerals throughout the several views.

In the drawings:

FIG. 4 is a fragmental sectional view of the draft gear taken substantially along line 4—4 of FIG. 3, showing the components of the friction and cushioning mechanisms of the draft gear in their riding or neutral positions in association with the draft gear front follower;

Figures 1, 2, 3:
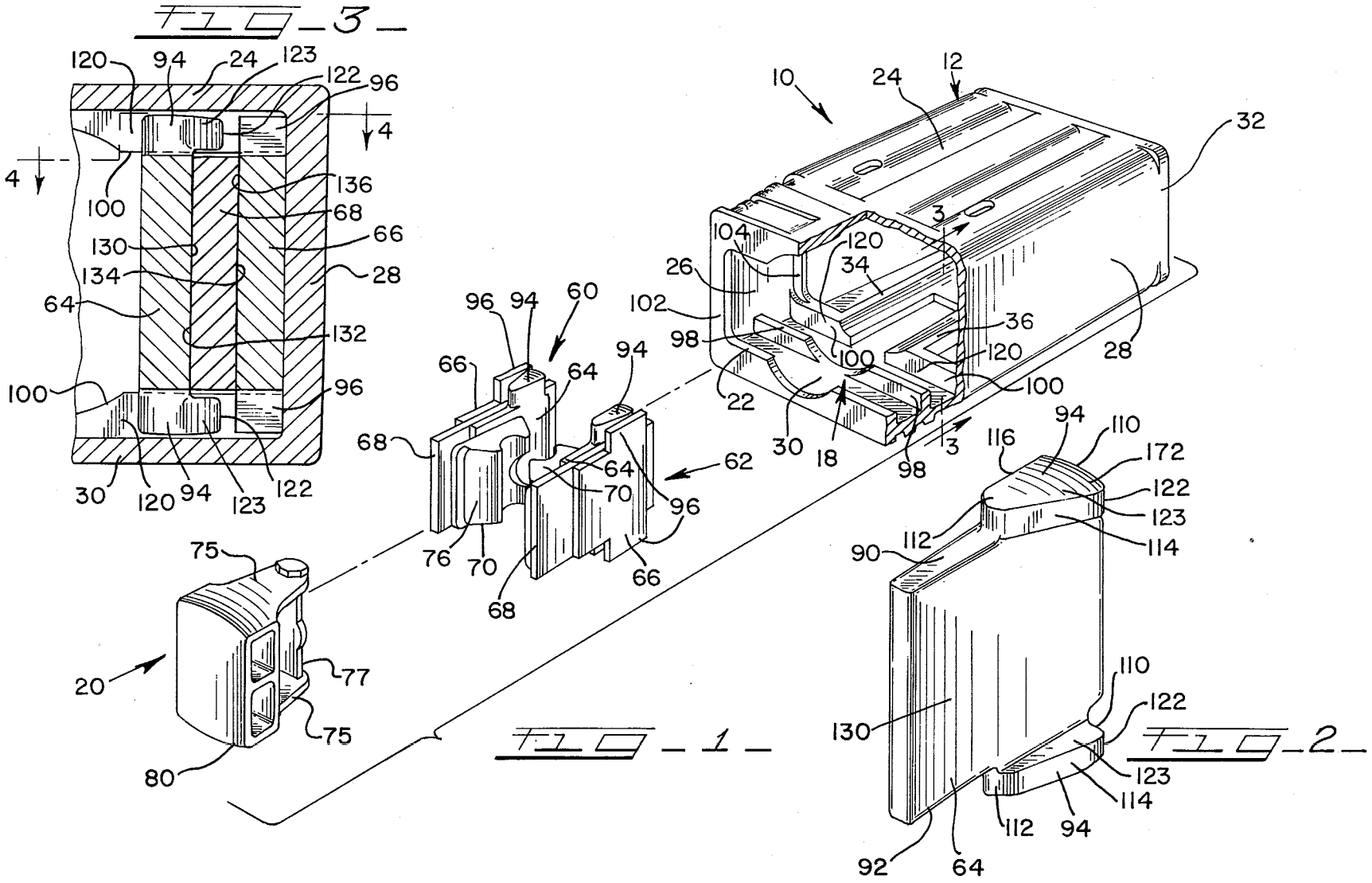
FIG. 1 is a diagrammatic perspective view of a draft gear housing and the friction mechanism associated with same, with the housing being partially broken away at its open end to better illustrate the internal construction of same, and with the cushioning mechanism that is ordinarily mounted in the rear chamber of the housing, and the intermediate and front followers, being omitted.
FIG. 2 is a diagrammatic perspective view of one of the inner fixed friction plates of the friction mechanism that is arranged in accordance with the present invention.
FIG. 3 is a fragmental cross-sectional view of the draft gear taken substantially along line 3—3 of FIGS. 1 and 4.

FIG. 5 is a view similar to that of FIG. 4, but illustrating the components of the friction and cushioning mechanisms of the draft gear in the fully closed relation of the draft gear (with the front follower omitted); and FIG. 6 is a fragmental cross-sectional view of the draft gear taken substantially along line 6—6 of FIG. 4, showing the fixed and movable plates on that side of the draft gear, with parts being broken away and other parts omitted to simplify the illustration.

Reference numeral 10 generally indicates a draft gear arranged in accordance with the general arrangement illustrated in U.S. Pat. No. 2,916,163, for illustration purposes, as the invention could also be similarly illustrated utilizing the showings of the other patents referred to hereinbefore. The draft gear 10 generally comprises a housing 12 having a rear chamber 14 for a cushioning mechanism 16, and a front chamber 18 housing a friction mechanism 20 arranged in accordance with the present invention, with the front chamber 18 being open as at 22 at the forward end of the housing, and being in open communication with the rear chamber 14.

The specific housing 12 is an oblong rectangular hollow casting formed from steel or the like having top wall 24, side walls 26 and 28, bottom wall 30, and a closed end wall (not shown) at the rear end 32 of the housing. The housing 12 is arranged substantially as shown in said U.S. Pat. No. 2,916,163, and thus defines along its upper and lower walls 24 and 30 a pair of laterally spaced apart parallel longitudinally extending ribs 34 and 36 which partially define a main spring chamber 38 in which are mounted coil springs 40 and 42 that are compressed against the rear wall of the housing and bear against intermediate follower 44. As disclosed in said patents, the ribs 34 also define upper and lower auxiliary corner spring chambers which receive upper and lower corner coil springs 46, while the ribs 36 partially define upper and lower auxiliary corner spring chambers which receive corner springs identical to the springs 46. The corner springs 46 bear against the intermediate follower 44 as well as the rear wall of the housing 12.

The intermediate follower 44 is located in the housing 12 forwardly of the cushioning mechanism 38 and rearwardly of the friction mechanism 20, and includes a base plate 48 that provides spring seats for the springs 40, 42 and 46 and a wedge portion 50 that cooperates with the friction mechanism 20.

The friction mechanism 20 is of the energy dissipative type and comprises (see FIG. 1) two groups 60 and 62 of intercalated plates each including an inner or stationary plate 64, an outer or stationary plate 66, and a movable plate 68. Between the inner stationary plates 64 of each group 60 and 62 are disposed a pair of laterally spaced friction wedge shoes 70 having oppositely and outwardly facing friction surfaces 72 cooperating with inwardly facing friction surfaces 74 of the respective stationary plates 64. The wedge shoes 70 have forward wedge surfaces 76 that cooperate with similarly contoured wedge surfaces 78 on the central friction wedge or plunger 80, and rearward wedge surfaces 82 that will cooperate with the wedge surface 84 formed on the forward end of the intermediate follower 44. The intermediate follower includes rearwardly extending stem portion 86 about which coil spring 42 is seated, and which is arranged in accordance with U.S. Pat. No. 2,916,163 to provide the columnar stability to the cushioning mechanism 38 that is disclosed in said patent. The intermediate follower 44 is also equipped with auxiliary spring seats 88 on which the corner springs 46 seat.

The central plunger 80 includes a pair of vertically spaced rearwardly extending arms 75 that are bridged by transverse wall 77 which forms a spring seat 79 for one end of release spring 81, the other end of which seats against intermediate follower 44.

The inner and outer stationary or fixed plates 64 and 66 of the friction mechanism 20 are each formed along their respective side edges 90 and 92 with laterally extending lugs 94 and 96, respectively, which are disposed between vertical ribs 98 and 100 of the housing that are integral with the housing arranged in opposed pairs on the upper and lower sides of the outer chamber 20. The outer stationary plates 66 are also held by the housing side flanges 102 and 104 that are formed on either side of the housing. The lugs 94 and 96 of the inner and outer fixed plates seat against the respective housing ribs 100 to resist movement of the stationary plates 64 and 66 inwardly or rearwardly of the housing 12, and seat against the respective housing ribs 98 under the biasing action of the srings of the cushioning mechanism 16 (that restores the gear to neutral position after an impact).

In accordance with the present invention, the lugs 94 of the inner stationary plates 64 are of special configuration. As indicated in FIGS. 2, 4 and 5, they are of generally triangular shaping defining a base portion 110 of extended dimension, a truncated, generally angular apex portion 112, a diagonal side portion 114, and a rectilinear side portion 116 that is coplanar with the friction surface 74 of the inner stationary plate 64.

As indicated in FIG. 3, the lugs 94 have a transverse dimension that is somewhat less than the lateral dimension of the abutment surface 120 of the respective housing ribs 98 and 100, with the lugs 94 projecting laterally outwardly of the plane of the friction surface 130 in the direction of the plane of the fixed outer plate 66. In accordance with the present invention, the outwardly directed corner portion 122 of the respective lugs 94 should extend closely adjacent to the plane of the respective outer plates 66, and specifically, adjacent to the lugs 96 thereof, but short of contact with same, and within the confines of the space defined by ribs 98 and 100 on either side of the respective movable plates 68. It is preferred that the corners 122 project laterally outwardly of the housing at least beyond the mid portion of the respective movable plates 68, but yet be sufficiently short of contact with lugs 96 so that, taking normal wear into account, lugs 94 will be free of engagement with the outer fixed plates 66 during the normal life of the gear.

However, the lugs 94 should not extend inwardly of the housing (or toward the shoes 70) beyond the plane of friction surface 74 to avoid interference with shoes 70.

The base portion 110 of the lugs 94 defines a lug engaging surface 126 of substantial area that is formed for flush engagement with the respective surfaces 120 of the ribs 100 for minimizing the force concentrations on such ribs 100. As indicated in FIGS. 4 – 6, surfaces 120 and 126 are essentially flat. In the form shown, diagonal portions 114 of lugs 94 are angled at approximately seventy degrees relative to the plane of surface 126 for forming lugs 94 to have good thrust resisting characteristics. The apex portions 112 of the lugs 94, to which diagonal portions 114 extend, are at approximately the mid length portions of the respective plates 64.

Furthermore, the proportioning of the lugs 94 laterally outwardly of the inner plates 64 is such as to securely brace such plates 64 against rotational tendencies acting on same during preliminary closure of the gear.

The inner stationary plates 64 define planar friction surfaces 130 that are in sliding engagement with the respective planar friction surfaces 132 of the movable plates 68, while the movable plates 68 define planar friction surfaces 134 that are in sliding frictional engagement with the planar frictional surfaces 136 of the outer stationary plates 66. The movable plates 68 are proportioned to have the relation indicated in FIG. 4 relative to the gear front follower 140 and the intermediate follower 44, whereby when the gear 10 is in its neutral riding position, the inner ends 150 of the movable plates 68 engage the intermediate follower 44 and the outer ends 152 of same are spaced from the front follower 140 a predetermined distance. The front follower 140 in the neutral riding position of the gear bears against the outer end 154 of the friction wedge member 80.

As indicated hereinbefore, the spacing of the outer ends 152 of the movable plates 68 from the front follower 140, and specifically, from its abutment surface 160, is of critical significance since it is the travel of the front follower from the position of FIG. 4 to engagement with the outer ends 152 of the movable plates that defines the portion of the gear cushion stroke which accommodates individual car start up of each car in a train when a locomotive is actuated to put a train into motion. When wear or other conditions in the gear are such that in the riding or neutral position of the gear, the outer ends of the movable plates are flush with the front follower face or surface 160, the gear is generally considered in need of repair to restore the condition illustrated by FIG. 4. Thus, the spacing of the outer ends 152 of the movable plates 68 from the front follower 140 is a measure of the useful life of the draft gear before shopping of the car, to repair the draft gear or replace same, as needed.

The factors causing wear in the friction mechanism 20 that will lead to the end of the useful life of the gear 10 are complex, but the applicant's studies of the problem have led him to conclude that several critical aspects are involved. One has to do with the tendency of the inner stationary plates 64, when arranged in accordance with prior art practices, to so impinge against the surfaces 120 of the housing ribs 100 that, gradually, indentations become formed in the ribs 100, thereby resulting in inward movement of the plates 64 and a corresponding outward movement of the movable plates 68, when the gear returns to its neutral position, thereby measurably shortening the useful life of the gear. Another has to do with wear tendencies of friction surfaces 72 and 74 of the cooperating shoes 70 and fixed inner plates 64, particularly adjacent the outer ends of the plates 64.

Another consideration involved is concerned with the manner in which the forces act in being transmitted through shoes 70 to fixed inner plates 64.

During initial closure of the gear, the forces applied to the wedge shoes 70 by the wedge member 80 tend to be concentrated at the outer ends of the shoes 70. This is represented by the arrows 170 of FIG. 4. The arrows 170 each represent a force concentration in the form of a vector, and thus each arrow 170 represents a resultant force acting in the laterally angled direction indicated (during initial closure of the gear) as a result of forces applied to the respective shoes by friction wedge 80, and acting longitudinally of the gear, with due consideration being given to the effect on that force of the friction forces, and thus, the coefficients of friction, that are involved. As arrows 170 represent resultant forces they are appropriately located at the midportions of the engaging portions of the respective sets of friction surfaces 76 and 78 (see FIG. 4). The nature of the parts involved in friction mechanism 30 is such that, as to the shoes 70 and fixed plates 64, the angulation of the vector representing arrows 170 laterally or sidewise of the gear is dependent on the magnitude of the coefficient of friction involved, with the result that even a relatively low coefficient of friction consideration involved in the force location represented by arrows 170, that is, adjacent the outer ends of the plates 64, will induce a rotating or rocking motion laterally outwardly and rearwardly of the housing, which is believed to be a cause of undue wear at the impingement of the surfaces 130 and 132 of the plates 64 and 68. Higher coefficients of friction will angle arrows 170 even further with respect to the longitudinal axis of the gear (and the center line of draft).

The general arrangement of the integral lugs 94 of the stationary inner plates 64 has several important effects. For one, the increasing of the area of engagement of the lugs 94 with the housing ribs 100 to the extent indicated effects a sufficiently minimumized force concentration to avoid the aforementiond indentation action that has heretofore produced undesirable looseness in the friction mechanism 20. This area of engagement is increased approximately 50 percent compared to the commercial embodiment of the arrangements shown in U.S. Pat. No. 2,916,163.

Furthermore, the lateral extensions 123 defined by the lugs 94, laterally outwardly of the housing, and beyond the planes of friction surfaces 130, as well as forwardly of the housing to the location of their apex portions 112 (and thus to the right of FIG. 4), provide the critical bracing needed for the stationary plates 64 that holds them against the aforementioned rocking tendencies that may occur during the preliminary portion of the closure stroke of the gear. As up to 80 percent of the impacts cushioned by the gear 10 will be of this variety, involving low speed impacts up to about a travel of up to about two inches, the wear reducing results of the new arrangement indicated will be apparent.

It is also significant that at the lower and medium speed impacts, the coefficient of friction of the friction surfaces engaging in the mechanism 20, and the resulting friction forces, are higher than at high speed impacts. Thus, undue lateral impingement of the inner friction mechanism components against the movable plates thereof, during initial gear closure, accelerate wear problms already made difficult by the high frequency of low speed impacts encountered. It is wear of this type that is alleviated by the special nature of the inner stationary plate lugs 94. In prior art arrangements of the type represented by U.S. Pat. No. 2,916,163, the vectors represented by arrows 170 of FIG. 4, on initial gear closure at low speed impacts, may be so close to the outer ends of the inner fixed plates 64 that shoes 70 may actually swing laterally outward and effect a sawing action on the outer ends of the inner fixed plates 64.

As the gear moves to full closure, the vectors represented by arrows 170 shift to the position of FIG. 5 relative to plates 64, 66 and 68, on either side of the draft gear. As the coefficient of friction of the friction surfaces engaging in the mechanism 20 are less for high speed impacts, than for lower and medium speed impacts, the sidewise cocking action of the vectors represented by arrows 170 is less, and the mechanism parts move quickly to the position of FIG. 5, with resulting lessened rocking action on the plates 64. While high speed impacts are undesirable for many reasons, their relative infrequency and the lessened rocking action induced by same on plates 64 results in far less severe wear on plates 64 and 68, than the aforementioned wear caused by low and meium speed impacts.

A special consideration is in the case of hydraulic draft gear of the type disclosed in said U.S. Pat. No. 3,150,782 as well as related U.S. Pat. No. 3,368,698. In the case of hydraulic draft gear, wherein a substantially constant force travel closure characteristic is a usual feature of the hydraulic cushioning device, the force levels generated by the gear resistance rise to substantially a maximum within the first few increments of draft gear travel. The bracing relation provided by the lugs 94 of the stationary plates 64 is thus especially useful in hydraulic gear, in overcoming the rocking action heretofore induced in scuh plates by conventional arrangements, and particularly so with regard to low speed impacts.

The gear 10 may be assembled substantially as described in U.S. Pat. No. 2,916,163. In practice the fixed plates 64 and 66 of friction mechanism are individually applied to the housing 12 by disposing them crosswise of their positioning of FIG. 1, inserting them through the housing open end 22 into front chamber 18 to the point where their lugs 94 and 96 are aligned with the space between the respective sets of housing ribs 98 and 100, and then rotating them to their positions transverse of the housing. The extensions 123 of lugs 94, for this purpose, have their outer surfaces 172 rounded and struck on a diameter that is equal to or less than the fit of the respective lugs 94 between housing walls 24 and 30, to avoid interference with such housing walls as the plates 64 are being positioned as indicated.

It will therefore be seen that the invention provides a simple but effective way of holding the gear fixed inner plates against the lateral forces acting on same, that are generated by the friction shoes and thereby avoid outward rotation tendencies of these parts that tend to unduly bind the parts together and thus accelerate wear tendencies, and particularly for the frequently encountered low speed impacts. Furthermore, this is done using a lug structure that also serves the purpose of minimizing stress concentrations on the housing ribs which absorb the thrusts that act through the stationary inner plates.

It is a fact of life in this art that movement outwardly of the housing, by the movable plates 68, as the gear wears, a distance of from one-sixteenth to about one-eighteenth of an inch represents a decrease in the useful life of the gear of about 100,000 miles. The beneficial effects achieved by the practice of the invention in minimizing wear on the friction device components and metal working of the housing ribs 100 can thus be expected to extend the useful life of the gear a corresponding amount for each increment of reduction of the progress of the gear movable plates in the direction of the gear front follower (in returning to neutral position), with the gear and thus the car remaining available for useful service that much longer.

Furthermore, since the wedge shoes 70 are relieved of thrust loading against the intermediate follower when the front follower engages the movable plates 68, and thus are in the aforementioned loosened condition, it is important that the preliminary closure travel represented by the spacing of the ends 152 of the movable plates 68 from the follower 140 be maximized for the longest possible time to maximize the useful life of the gear before shopping is required. In their loosened state the shoes 70 can get out of alignment and cocked or tilted so that, after the gear returns to neutral position and the gear in question is subjected to a high speed impact, the gear housing can be ruptured due to the prying action on same by the tilted shoe (most gear breakage can be attributed to this problem).

Underlining the importance of this invention in maximizing the length of service that the follower 140 will have adequate travel before engaging the fixed plates 68 is the fact that currently AAR rules for "total" inspection of cars (that calls for, among other things, an inspection of the draft gear to confirm adequacy of the preliminary travel, failing which the car must be shopped), permit an eight year period between such inspections, and this period is likely to be extended in the near future. Under today's traffic conditions, cars experience higher yearly mileage and higher over the road speeds than formerly could be expected, which also emphasize the importance of the invention.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a draft gear for railroad cars including a housing having front and rear ends and defining a rear chamber at the rear end of the housing and a front chamber at the front end of the housing in open communication with the rear chamber and open at the front end of the housing, said housing having opposed top and bottom walls and a pair of opposed side walls separating said top and bottom walls to define said chambers, cushioning means in the rear chamber, an intermediate follower seated against said cushioning means, with each of the housing side walls carrying in the housing front chamber adjacent said housing front end an inwardly facing friction surface, with said side friction surfaces facing each other, an energy dissipative friction device mounted in the housing front chamber and comprising a pair of fixed plates disposed between the housing side wall friction surfaces, said fixed plates substantially paralleling said housing side walls and each defining a first friction surface facing one of said side wall friction surfaces, a second friction surface facing the other housing side wall, and upper and lower side edges opposing the housing top and bottom walls, respectively, a pair of movable plates extending through the front chamber and engaging the intermediate follower, with one of the movable plates being interposed between one of the fixed plates and the housing side wall friction surface opposing said one fixed plate, and the other movable plate being interposed between the other fixed plate and the housing other side wall friction surface facing said other fixed plate, said movable plates defining side edges opposing the housing top and bottom walls, respectively, a pair of wedge shoes having wedge surfaces facing sidewise of said housing interposed between and engaging the respective second friction surfaces of said fixed plates, and a thrust wedge acting between said shoes to urge said wedge surfaces of said shoes into cooperation with the fixed plates during compression of the gear, with the housing top and bottom walls at said front chamber being formed to define opposed pairs of inner and outer ribs spaced apart longitudinally of the housing and extending transversely of the housing and crosswise of said plates, and with said movable plates on either side of the housing in extending through the housing front chamber being disposed between said rib pairs thereof to present the inner ends of said movable plates for engagement with the intermediate follower, and front follower means acting consecutively on said thrust wedge and the outer ends of said movable plates to force same inwardly and longitudinally of said housing on compression of the gear, the improvement for prolonging the useful life of the gear as represented by the spacing of said outer ends of said movable plates from said front follower means in the riding position of said gear, said improvement comprising:

said fixed plates each including on each side edge of the respective fixed plates a lug seated between the ribs of the housing top and bottom wall rib pairs to hold said fixed plates against movement longitudinally of the housing on compression of the gear, said lugs respectively projecting laterally from said side edges of the respective fixed plates in the direction of, but short of, the housing side wall friction surfaces opposing the respective first friction surfaces of the respective fixed plates and forming at the inner ends of the respective lugs thrust resisting abutments of extended area of engagement with the inner rib of the respective housing rib pairs, said lugs of each fixed plate, at said abutments thereof, defining portions overlapping the respective side edges of the respective movable plates adjacent same in the direction of the respective housing side walls a distance that at least equals approximately one half the thickness of the respective movable plates for bracing the respective fixed plates against rocking in the direction of the respective housing side walls on compression of the gear, said lug overlapping portions defining corner portions facing the respective housing side wall friction surfaces that the respective lugs project toward, and diagonal bracing portions extending from the respective lug corner portions to the respective fixed plate side edges adjacent the median portions of the respective fixed plates for bracing the respective lug corner portions against the respective fixed plates to resist said rocking of said fixed plates under force concentrations acting in the directions of said housing side walls against said fixed plates adjacent their outer ends on compression of the gear prior to engagement of the outer ends of said movable plates by said front follower means on initial compression of the gear.

2. The improvement set forth in claim 1 wherein:

said lugs at said bracing portions thereof are angled on the order of seventy degrees relative to the respective lug abutments.

3. The improvement set forth in claim 2 wherein:

said lugs are generally triangular in outline configuration, with said lugs respectively being free of projection toward the respective housing side walls faced by the second friction surfaces of the respective fixed plates.

4. The improvement set forth in claim 1 wherein:

said lugs of each fixed plate are convexly rounded at the upper and lower extremities of the respective fixed plates on a diameter substantially equal to or less than the fit of the respective fixed plate lugs between the housing top and bottom walls overlying same.

* * * * *